United States Patent [19]

Takamura et al.

[11] Patent Number: 4,560,844

[45] Date of Patent: Dec. 24, 1985

[54] KEY-HOLDING STRUCTURE OF A KEYBOARD WITH CURVED OPERATING SURFACE OF KEYS

[75] Inventors: Toshiro Takamura; Muneharu Kakumu, both of Nagoya, Japan

[73] Assignees: Brother Kogyo Kabushiki Kaisha; Sohwa Seiki Kabushiki Kaisha, both of Nagoya, Japan

[21] Appl. No.: 624,395

[22] Filed: Jun. 25, 1984

[30] Foreign Application Priority Data

Jul. 11, 1983 [JP] Japan ..... 58-125740
Aug. 17, 1983 [JP] Japan ..... 58-127529[U]
Aug. 17, 1983 [JP] Japan ..... 58-127530[U]

[51] Int. Cl.[4] ..... H01H 9/00; H01H 13/70

[52] U.S. Cl. ..... 200/5 A; 200/159 B; 200/293; 235/145 R; 400/488

[58] Field of Search ..... 200/5 A, 159 B, 292–296, 200/302.2, 340; 361/398, 288; 235/145 R; 400/479, 485–489, 490, 495

[56] References Cited

U.S. PATENT DOCUMENTS

Re. 30,435 11/1980 Fukao ..... 361/288 X
3,311,210 3/1967 Peroni ..... 400/479
4,271,333 6/1981 Adams et al. ..... 200/5 A X
4,294,555 10/1981 Galaske et al. ..... 400/490 X
4,363,942 12/1982 Deeg et al. ..... 400/495 X
4,423,464 12/1983 Tamura et al. ..... 361/288
4,440,515 4/1984 Nassimbene ..... 400/490 X
4,467,150 8/1984 Leitermann et al. ..... 400/488 X

*Primary Examiner*—J. R. Scott
*Attorney, Agent, or Firm*—Browdy and Neimark

[57] ABSTRACT

A keyboard having multiple key-switches, wherein a surface generally defined by top faces of keys of the key-switches is downwardly curved in a plane perpendicular to rows of the keys, comprising an upper casing of synthetic resin which includes a top frame portion having a rectangular aperture and side walls defining right and left sides of the aperture. The top frame portion has downward extensions extending downwardly from the side walls. The upper casing further comprises a key-holder plate portion of planar flat shape for supporting the rows of the keys perpendicular to the right and left sides of the aperture. The top frame portion and the key-holder plate portion are molded integrally into the upper casing such that transversely central areas of right and left side end regions of the key-holder plate portion are connected to the downward extensions of the top frame portion, and such that the key-holder plate portion is spaced from the downward extensions, except at the transversely central areas of the side end regions. The keyboard comprises a holding device for holding the key-holder plate portion curved in cross section across the rows of the keys.

22 Claims, 15 Drawing Figures

KEY-HOLDING STRUCTURE OF A KEYBOARD WITH CURVED OPERATING SURFACE OF KEYS

BACKGROUND OF THE INVENTION

The present invention relates to a keyboard assembly for providing electrical outputs corresponding to multiple keys, to signal utilization electronic devices such as typewriters and other data processing equipment.

In such a keyboard for electronic devices, a multiplicity of keys are disposed in plural rows to provide electric signals corresponding to the keys which have been depressed on their top faces. To improve ease of operation of the keys, attempts based on human engineering or ergonomics have been made to arrange the keys such that an operating surface generally defined by the top faces of the individual keys is curved to a downwardly convex shape in cross section taken along a line perpendicular to the rows of the keys. There have been proposed the following two methods to obtain such a curved operating surface of the keyboard.

These two methods will be described with reference to FIGS. 12 and 13.

The first method uses a curved key holder plate 2 having multiple guide holes 1, as shown in FIG. 12. The holder plate 2 is made from a steel plate by shaping it to a suitable curvature in the transverse cross section. In the guide holes 1, keystem guides 5 are fixedly inserted to slidably guide respective keystems 4 which carry at their upper ends keytops 3 having the finger-pressed top faces. In this case, the keys (3, 4) are all equally sized so that an operating surface 6 defined by the top faces is curved substantially to the curvature of the key holder plate 2.

In this method, however, it is required to fix the individual keystem guides 5 in the guide holes 1 formed in the shaped key holder plate 2. This assembling procedure is cumbersome and time-consuming, and reduces the efficiency of manufacture of the keyboard to an appreciable extent, and accordingly pushes up the cost of manufacture.

While the above method is advantageous in that the key holder plate 2, which is shaped under plastic working from a metal sheet, is capable of maintaining an initially given curved profile virtually permanently, the metal plate is required to be relatively thick for permanency of the original shape, and this inherently increases a total weight of the keyboard assembly, which may be considered as an undesired factor in the recent trend in the art toward providing compact and lightweight equipment.

The second method is illustrated in FIG. 13, wherein an upper casing 7 of a keyboard is provided with integrally formed keystem guides 8 which slidably support respective keystems 9 having keytops 10 fixed to their upper ends. In this method, an operating surface 11 of the keyboard is established by forming the keytops 10 in different sizes and shapes, depending upon the positions in which they are disposed. For example, the keytops 10 carried on the keystems 9 disposed in one of plural rows are formed with a top face having a curvature which is different from that of the keytops 10 carried on the keystems 9 in another of the plural rows.

Thus, the above second known method requires different kinds of keytops or keytops and keystems to provide different contours of top faces of the keys so that the top faces cooperate to form the curved operating surface 11. This means a need of using different kinds of molds for forming the different keys, and consequently an increased cost of manufacture of the keyboard assembly.

In the light of the above inconveniences of the known keyboards, an improved keyboard is proposed as disclosed in Japanese Patent Application No. 58-59365 filed on Apr. 20, 1983 (which has not been published at the time of filing the present application) in the name of one of the assignees of the present application. The corresponding U.S. patent application, Ser. No. 598,920 was filed on Apr. 10, 1984 now U.S. Pat. No. 4,528,428, and assigned to said one of the assignees of the present application. The keyboard as shown in the above U.S. patent application, includes a key holder plate of synthetic resin which has plural rows of holes and annular guide portions concentric with the holes so that plural rows of keys are carried movably through the holes and the guide portions. The key holder plate is disposed so as to close a rectangular aperture formed in an upper casing so that the keys extend through the aperture. Below the key holder plate, there is disposed a printed circuit board which includes a substrate carrying on its upper surface multiple pairs of stationary electrodes, and which further includes an elastomeric member having multiple frusto-conical elastic housings. On an inner surface of the top wall of each elastic housing, there is bonded a movable electrode which is disposed opposite to the corresponding pair of stationary electrodes. This printed circuit board is disposed below the key holder plate so that key switches comprising the keys and the movable and stationary electrodes are operated through depression of the keys in a known manner. To establish a curved operating surface of the top faces of the keys, a curved retainer plate made of metal is used. This retainer plate is formed with a predetermined curvature in cross section along a line perpendicular to the rows of the keys. The key holder plate and the printed circuit board are placed on the curved retainer plate. In this condition, the retainer plate and the printed circuit board are fixed to the upper casing with one set of screws, and the retainer plate is further secured to the upper casing with another set of screws. With the retainer plate fixed to the upper casing, the printed circuit board and the key holder plate are held curved along the curvature of the curved retainer plate, and along a convex lower end profile of downward extensions which are provided on the lower surface of the upper casing on both right and left sides of the rectangular aperture.

Thus, the operating surface of the key top faces of the above proposed keyboard is downwardly curved for easy operation of the keys. This curvature is obtained without forming the keys in different sizes and shapes depending upon their positions on the key holder plate. Further, the fabrication of a planar key holder plate with integral guide portions of the proposed keyboard is easier than the traditional fabrication of a curved key holder plate with integral guide portions by molding of a synthetic resin material. In molding such a curved key holder plate with the guide portions, there is a problem of mold release because the guide portions are formed in radial directions.

However, the above arrangement of the keyboard proposed in U.S. Pat. No. 4,528,428 requires a precise positioning of the upper casing, key holder plate, printed circuit board and curved retainer plate, with respect to each other. In particular, the key holder plate should be accurately positioned relative to the downward extensions on the sides of the rectangular aperture. This positioning is relatively difficult and troublesome, because the components are secured to the upper casing by using many screws at different locations.

Further, the above arrangement requires the printed circuit board to be be curved while the curved retainer plate is fixed to the upper casing with screws. That is, the key holder plate is curved through deformation of the printed circuit board while the retainer plate is fixed to the upper casing. This method leaves a possibility of incomplete flexure or deformation of the printed circuit board, which results in the failure of the key holder plate to be given an intended curvature in conformity with the curvature of the curved retainer plate.

The use of a curved retainer plate of metal in the above proposed arrangement is advantageous for permanency of its initial curvature created through plastic deformation thereof, i.e., highly capable of maintaining the designed curvature of the operating surface of the keys. However, this metal plate is required to be relatively thick for permanency of its shape, thereby causing an increase in total weight and depth of the keyboard assembly.

SUMMARY OF THE INVENTION

It is accordingly an object of the present invention to provide a keyboard having a downwardly curved operating surface of keytops, which offers the advantages of the keyboard proposed in U.S. Pat. No. 4,528,428, and which is easy to assemble with minimum number of components and minimum effort for positioning the components relative to each other.

According to the invention, there is provided a keyboard having multiple key switches which provide electrical outputs upon activation thereof, each of the key-switches including a key having a finger-pressed top face. The instant keyboard comprises an upper casing made of synthetic resin including a top frame portion and a key-holder plate portion. The top frame portion has a substantially rectangular aperture formed through a thickness thereof, and further has a pair of side walls defining opposite right and left sides of the rectangular aperture. The top frame portion further has a pair of downward extensions which extend downwardly from the respective side walls. The key-holder plate portion is of generally planar flat shape and supports the multiple keys in plural rows perpendicular to the right and left sides of the rectangular aperture. The key-holder plate portion has right and left side end regions opposite to the downward extensions. Transversely central areas of these side end regions of the key-holder plate portion are connected, during molding of the upper casing, to the downward extensions of the top frame portion. The key-holder plate portion is spaced from the downward extensions and other sections of the top frame portion, except at the transversely central areas of the side end regions which are connected to the downward extensions during molding of the upper casing. The keyboard further comprises holding means for holding the key-holder plate portion curved in cross section across the plural rows of the keys, so that a surface generally defined by the top faces of the multiple keys is downwardly curved in the cross section taken along a line perpendicular to the rows of the keys.

In the keyboard constructed as described above, the key-holder plate portion is integrally formed with the top frame portion during molding of the upper casing, such that only the transversely central areas of the opposite right and left side end regions of the plate portion are connected to or united with the downward extensions which are formed on the lower surfaces of the side walls of the top frame portion, which side walls define the opposite right and left sides of the rectangular aperture. Thus, the position of the key-holder plate portion, i.e., of the keys relative to the rectangular aperture in the top frame portion is precisely established in the process of plastic molding of the upper casing. The key-holder plate portion is kept flat before the keyboard is assembled. In assembling the keyboard, the flat key-holder plate portion is forced into a curved position by suitable holding means so that the operating surface of the key tops is of downwardly convex shape. In this arrangement, the positional relation between the top frame portion and the key-holder plate portion is not affected during the assembling operation in which other components such as a printed circuit board are secured to the upper casing.

According to an advantageous form of the invention, each of the downward extensions has a convex profile at its lower end with which the side end regions of the key-holder plate portion are kept in pressed contact by suitable retainers of the holding means. In this arrangement, the key-holder plate portion is held curved following the convex profile of the downward extensions, through elastic deformation of the key-holder plate portion which is made of synthetic resin.

According to one aspect of the invention, the holding means comprises a curved retainer plate, and fastening means for fixing the curved retainer plate to the top frame portion of the upper casing, and thereby holding the key-holder plate portion in a curved position.

In one form of the above aspect of the invention, the curved retainer plate is disposed below a printed circuit board which cooperates with the keys to provide the electrical outputs. Further, the retainer plate has engagement ribs along front and rear edges thereof parallel to the plural rows of the keys. These engagement ribs engage corresponding front and rear edges of the printed circuit board to hold the printed circuit board curved to a curvature of the retainer plate. The engagement ribs not only hold the circuit board in its curved position, but also serve to cause the circuit board to follow the exact curvature of the retainer plate because the ribs engaging the front and rear edges of the curved circuit board exert forces to the circuit board transversely thereof from its edges toward its transversely central portion. The fastening means fixes the curved retainer plate and the curved printed circuit board to the top frame portion of the upper casing, and thereby holds the key-holder plate portion curved in the curved position.

In the above arrangement, the printed circuit board may be held curved to an exact curvature of the retainer plate before these components are fixed to the upper casing. Hence, it is not necessary to force the printed circuit board with the retainer plate while these components are secured to the upper casing with screws.

According to an alternative aspect of the invention, the above indicated curved retainer plate may be replaced by a plurality of upward projections fixed to and extending from a bottom of a lower casing which cooperates with the upper casing to constitute a keyboard housing. These upward projections have upper ends which cooperate to define a curved bearing surface which is curved in a plane perpendicular to the rows of the keys. In this instance, the printed circuit board is fixed to the upper ends of the upward projections with suitable fastening means. For example, the upward projections may be a plurality of support walls extending in parallel with each other along or perpendicularly to the rows of the keys and are spaced from each other in a direction perpendicular or parallel to the rows of the keys. The support walls parallel to the rows of the keys, have different heights from the flat bottom of the lower casing so as to define the curved bearing surface at their upper ends on which the printed circuit board is held in abutment with fasters. In the case where the support walls are perpendicular to the rows of the keys, each of the walls has a curved upper end surface on which the printed circuit board is held in abutment with fasteners.

In this alternative arrangement, the printed circuit board is directly fixed to the upper end surfaces of the upward projections extending from the bottom of the lower casing, whereby the circuit board is held curved to a curvature defined by the upper end surfaces of the upward projections. This form of structure to give the key-holder plate portion a desired downward curvature requires a reduced number of parts, which means reduced weight and depth of the keyboard housing, easier assembling of the parts and reduced cost of manufacture of the keyboard.

BRIEF DESCRIPTION OF THE DRAWING

The above and other objects, features and advantages of the present invention will become more apparent from reading the following description of the preferred embodiments taken in connection with the accompanying drawing in which.

DETAILED DESCRIPTION OF THE PREFERRED EMBODIMENTS

Figure 1:
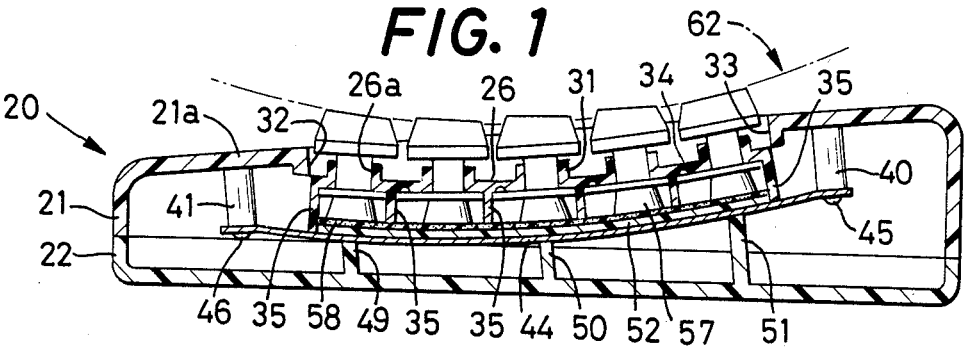
FIG. 1 is an elevational view in cross section of one embodiment of a keyboard of the invention.
Figure 2:
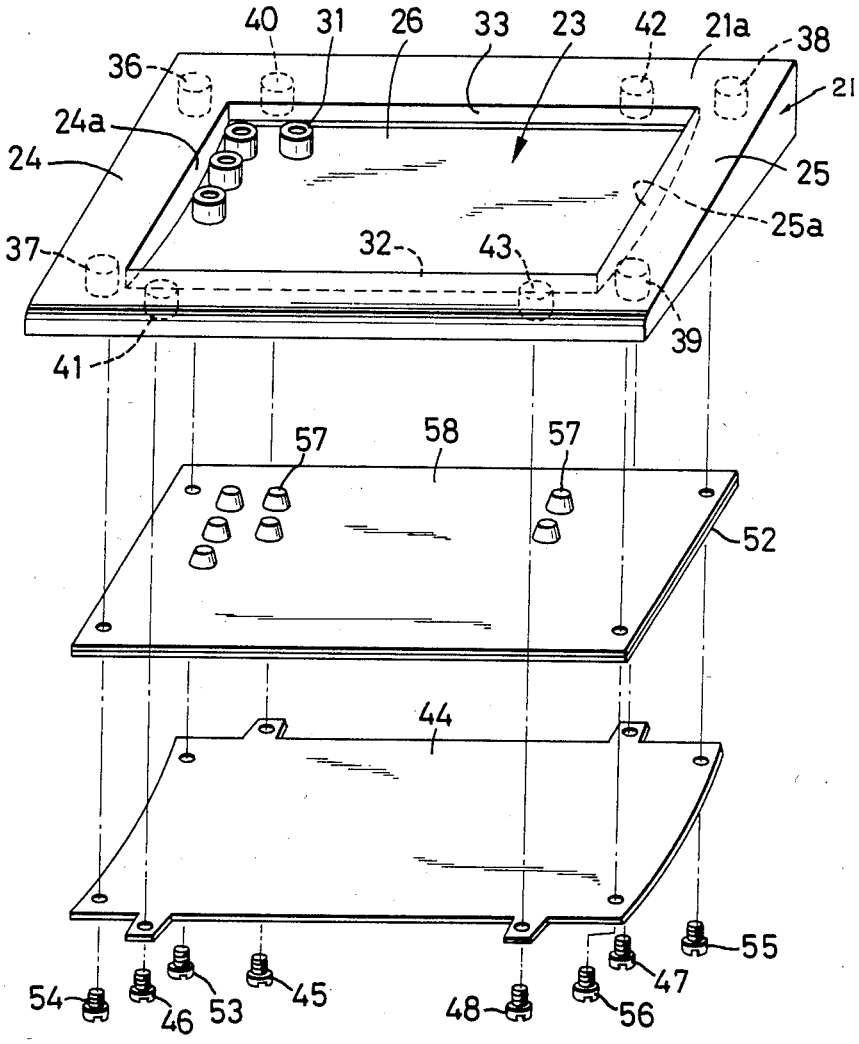
FIG. 2 is an exploded perspective view of the keyboard of FIG. 1.

Referring first to FIGS. 1–5, there is illustrated a first embodiment of a keyboard of the present invention, wherein a keyboard housing generally indicated at 20 in FIG. 1 includes an upper casing 21 and a lower casing 22, both made of synthetic resin in a plastic molding process. As shown in FIG. 2, the upper casing 21 includes a generally planar top frame portion 21*a* which has a substantially rectangular aperture 23 formed through the thickness of the portion 21*a*. The top frame portion 21*a* has a pair of side walls 24, 25 which define opposite right and left sides of the rectangular aperture 23. Each of the side walls 24, 25 has a downward extension 24*a*, 25*a* from the lower surface of the top frame portion 21*a*. The downward extensions 24*a*, 25*a* has a convex profile at its lower end.

The top frame portion 21 is formed integrally with a key-holder plate portion 26 of generally planar flat shape which is disposed below the lower surface of the top frame portion 21*a* so as to close the rectangular aperture 23. As partly shown in FIG. 3, the upper casing 21 is molded such that the right and left side end regions of the key-holder plate portion 26 are spaced a very small distance from the right and left downward extensions 24a, 25*a* toward the center of the portion 26 in a direction perpendicular to the side walls 24, 25. More precisely stated, a central part 24*a'*, 25*a'*, (25*a'* not shown) of each downward extension 24*a*, 25*a* is materially connected, during molding of the upper casing 21, to a transversely central area 26*b* of each side end region of the key-holder plate portion 26. Except the transversely central area 26*b*, the key-holder plate portion 26 is spaced or separated from the remaining parts of the top frame portion 21*a*. In other words, the upper casing 21 is molded so that the key-holder plate portion 26 takes a straight planer shape, i.e., lies in a plane. As described later, the key-holder plate portion 26 is curved during assembling of the keyboard.

Figure 3:
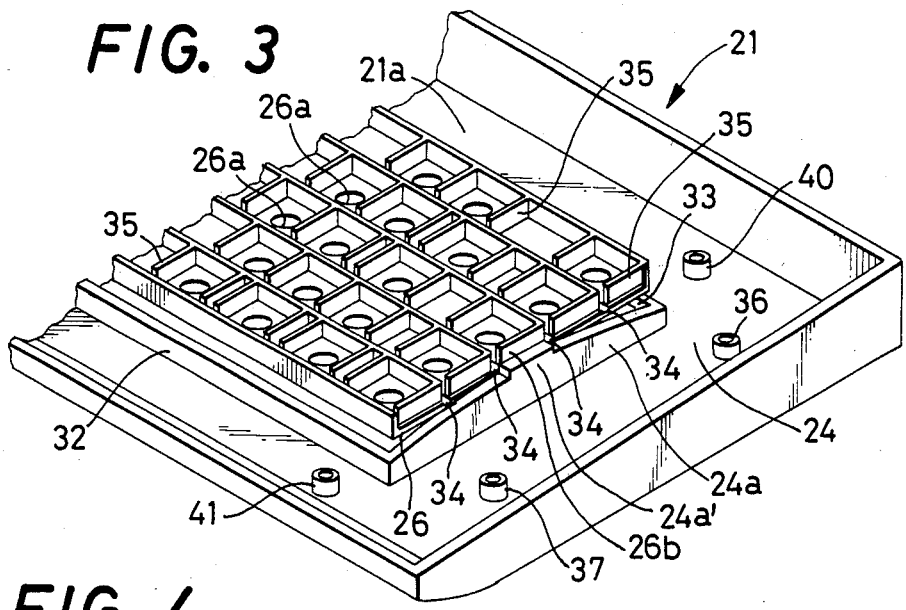
FIG. 3 is a perspective bottom view of an upper casing of the keyboard of FIGS. 1 and 2.

As shown in FIGS. 1 and 3, a multiplicity of holes 26*a* are formed in the key-holder plate portion 26 in plural rows parallel to the front and rear sides of the rectangular aperture 23. Along the peripheral edge of each of these holes 26*a*, is integrally formed an annular guide portion 31 which is concentric with the hole 26*a* and extends perpendicularly from an upper surface of the key-holder plate portion 26 towards the rectangular aperture 23, to support a key 30 which consists of a keystem 28, a keystop 27 fixed to an upper end of the keystem 28, and a bottom plate 29 of substantially rectangular shape which is fixed to a lower end of the keystem 28. The keystem 28 is inserted through the hole 26*a* and the annular guide portion 31, such that the key 30 is slidably movable in a direction perpendicular to the plane of the key-holder plate portion 26. Thus, the keys 30 are movably supported in plural rows parallel to front and rear sides 32, 33 of the rectangular aperture 23.

The key-holder plate portion 26 has, in its lower surface, four parallel grooves 34 of generally U-shaped cross section (FIGS. 1 and 3) which are formed parallel to the front and rear sides 32, 33 of the aperture 23, and between the rows of the holes 26*a*. These grooves 34 are provided to facilitate elastic deformation of the plate portion 26 which will be described later. For effective deformation of the plate portion 26, the two outer grooves 34 have a depth greater than that of the two inner grooves 34. In the case where many of such parallel grooves are provided, a depth of the grooves is increased as a distance of the groove from the transverse center of the plate portion 26 is increased. On the same lower surface of the key-holder plate portion 26, there are integrally formed multiple partition walls 35 which extend downwardly from the lower surface of the plate portion 26 so as to define multiple rectangular compartments in which the bottom plate 29 of each key 30 is guided upon movement of the key. In addition, the partition walls 35 serve to prevent the bottom plate 29 (and consequently the key 30) from rotating about an axis of the keystem 28.

The top frame portion 21*a* is provided with plural downward bosses 40–43 which protrude downwardly from the lower surface of the portion 21*a*. To the downward bosses 40–43 is fixed with fixing screws 45–48 a rigid curved retainer plate 44 made of metal which has a predetermined downward curvature in cross section across the rows of the keys 30, i.e., in a plane perpendicular to the front and rear sides 32, 33 of the aperture 23. The curved retainer plate 44 is supported at its lower surface by plural upward projections in the form of three support walls 49, 50, 51 which extend from an inner bottom surface of the lower casing 22 such that the upper ends of the projections 49–51 abut on the lower surface of the curved retainer plate 44. These support walls 49–51 are formed parallel to the front and rear sides 32, 33 of the aperture 23, and spaced from each other along the right and left sides of the aperture 23.

Figure 4:
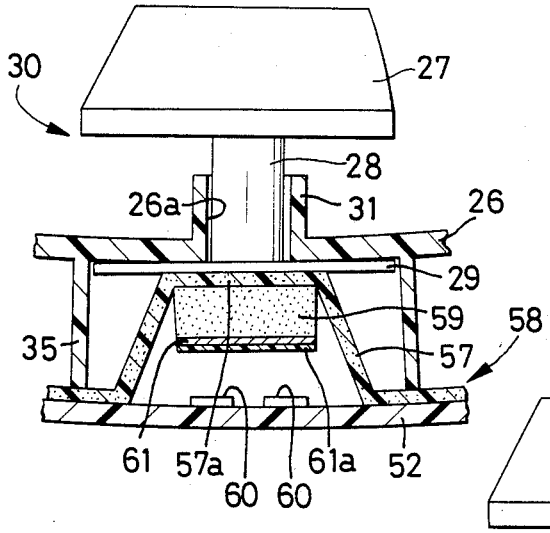
FIG. 4 is a cross sectional view in enlargement, showing one of key switches incorporated in the keyboard of FIGS. 1–3.
Figure 5:
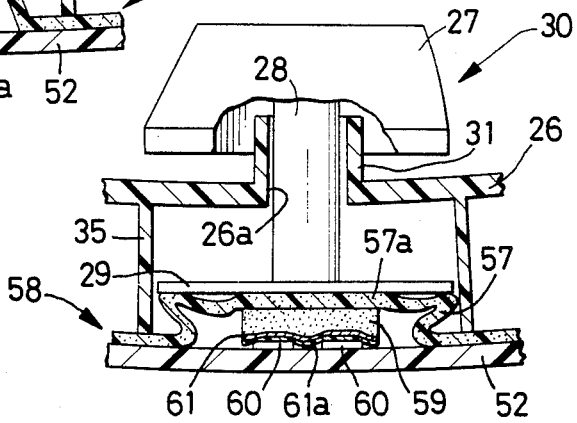
FIG. 5 is a cross sectional view in enlargement, showing the key switch of FIG. 4 in its closed or operated position upon depression of the key.

A printed circuit board 52 rests on an upper surface of the curved retainer plate 44. The printed circuit board 52 and the retainer plate 44 are fastened to the lower ends of the downward bosses 36–39 located on the undersurface of the top frame portion 21*a* of the upper casing 21 with fixing screws 53–56, respectively, such that the printed circuit board 52 backed or supported by the curved retainer plate 44 is also curved following the curvature of the retainer plate 44. The circuit board 52 comprises a substrate which carries on its upper surface a printed pattern of conductors, i.e., multiple pairs of stationary electrodes 60 as shown in FIGS. 4 and 5. The substrate carries, also on its upper surface, an elastomeric member 58 which is formed with multiple frusto-conical or inverted-cup-shaped elastic housings 57 made of rubber, each of which cooperates with the substrate to enclose the corresponding pair of stationary electrodes 60. Each frusto-conical elastic housing 57 has a top wall 57*a* which is spaced from and opposite to the stationary electrodes 60. A sponge member 59 is bonded at one surface thereof to an inner surface of the top wall 57*a* of the elastic housing 57. The sponge member 59 carries on the other surface thereof a movable electrode 61 made of flexible aluminum foil which is covered with a thin insulating film 61*a* made of flexible synthetic resin, such that the movable electrode 61 faces the stationary electrodes 60 via the insulating film 61*a*. This movable electrode 61 cooperates with the pair of stationary electrodes 60 to constitute a variable capacitor.

With the keyboard assembled as described later in greater detail, the key-holder plate portion 26 is held curved with the partition walls 35 held in contact with the elastomeric member 58 on the printed circuit board 52 which is held curved in contact with the curved upper surface of the retainer plate 44, because the retainer plate 44 is fixed to the top frame portion 21*a* of the upper casing 21. In this condition, the key-holder plate portion 21*a* is positioned so that the frusto-conical elastic housings 57 of the elastomeric member 58 are disposed within the compartments defined by the partition walls 35, and so that the bottom plate 29 of the key 30 rests on the top wall 57*a* of the elastic housing 57. More specifically described, the key 30 is biased by the elastic housing 57 and normally held in its upper, non-operated position of FIG. 4. In this non-operated position, the bottom plate 29 of the key 30 is forced against the lower surface of the key-holder plate portion 26, and the movable electrode 61 is separated from the stationary electrodes 60.

Each of the key switches constructed as described hitherto, is operated in the following manner:

Upon depression of the keytop 27 while the key 30 is located at its upper position of FIG. 4, the keystem 28 is moved downward while being guided by the annular guide portion 31, whereby the top wall 57*a* of the elastic housing 57 is forced down by the bottom plate 29 of the key 30. As a result, the assembly of the sponge member 59 and movable electrode 61 fixed to the top wall 57*a* is moved toward the printed circuit board 52, and the movable electrode 61 covered with the insulating film 61*a* is brought into contact with the pair of stationary electrodes 60 as shown in FIG. 5. In this operated position, the two stationary electrodes 60 are capacitively coupled to each other, and a high frequency signal is transferred from one of the electrodes 60 to the other. Since the movable electrode 61 is carried by the elastic sponge member 59 bonded to the top wall 57*a*, the movable electrode 61 may be held in close and perfect contact with the outer surfaces of the stationary electrodes 60, through elastic deformation of the sponge member 59, thereby assuring a stable transfer of the high frequency signal of sufficiently high level between the two stationary electrodes 60.

When the operator's finger pressure is released from the keytop 27, the resilient force of the elastic housing 57 causes the key 30 and the movable electrode assembly 59, 61, 61*a* to be moved upward to their original non-operated position of FIG. 4, whereby the movable electrode 61 is separated from the stationary electrodes 60, and the signal transfer between the two stationary electrodes 60 is ceased.

In the non-operated position, the rectangular bottom plate 29 of the key 30 prevents the keystem 28 from being pulled out of the annular guide portion 31, and cooperates with the partition walls 35 to avoid otherwise possible rotary movements of the key 30.

The keyboard of the present embodiment comprising the components which have been discussed, is assembled in the following manner:

In assembling the keyboard, the printed circuit board 52 is first placed on the curved retainer plate 44. Then, the elastomeric member 58 with the integrally formed elastic housings 57 is set on the printed circuit board 52. In the meantime, the keystems 28 with the bottom plates 29 are set in the key-holder plate portion 26 such that the keystems 28 are slidably movable through the holes 26*a* and the annular guide portions 31. The keytops 27 are then secured to the keystems 28. The curved retainer plate 44, and the board 52 and the member 58 set on the retainer plate 44, are fixed to the top frame portion 21*a* of the upper casing 21 with the fixing screws 53–56 threaded to the downward bosses 36–39. Further, the curved retainer plate 44 is secured to the top frame portion 21*a* with the fixing screws 45–48 screwed to the downward bosses 40–43, in order to complete the flexture of the key-holder plate portion 26 to the exact curvature of the retainer plate 44. When the assembly 44, 52, 58 is secured to the upper casing 21 with the screws 45–48 and 53–56, the key-holder plate portion 26 is comparatively easily curved with the aid of the parallel grooves 34, and the curved retainer plate 44 serves to hold the printed circuit board and the elastomeric member 52, 58 as well as the key-holder plate portion 26 in their curved posture. With the key-holder plate portion 26 thus retained in its curved posture, the keys 30 of the same size are supported by the key-holder plate portion 26 of the upper casing 21 so that the top faces of the keytops 27 define an operating surface 62 which is downwardly convexed to a curvature substantially identical to a curvature of the curved retainer plate 44. Finally, the lower casing 22 is coupled to the upper casing 21 to form the keyboard housing 20.

As described previously, the key-holder plate portion 26 with the integral annular guide portions 31 is molded as an integral part of the upper casing 21, that is, integrally formed with the top frame portion 21*a* having the aperture 23. Accordingly, the keys 30 movably supported by the key-holder plate portion 26 can be accurately positioned relative to the aperture 23. In other words, the relative positions between the keys 30 and the aperture 23 are not affected by the manner in which the keyboard is assembled. Thus, the instant keyboard can be easily assembled with increased accuracy of positioning the keys 30 relative to the upper casing 21. The integral formation of the key supporting structure and the top frame further results in reduction in total number of parts of the keyboard, and in the cost of manufacture.

As discussed previously, the key-holder plate portion 26 is provided with the annular guide portions 31 and the partition walls 35 which are formed on the flat surfaces of the planar substrate. That is, the key-holder plate portion 26 is molded to be of generally flat shape, and subsequently curved or flexed through elastic deformation thereof during the assembling of the keyboard. This design permits easy removal of molds that are used to mold the upper casing 21 with the guide portions 31 and the partition walls 35.

The provision of the parallel grooves 34 in the lower surface of the key-holder plate portion 26 contributes to easier flexture of the key-holder plate portion 26 to the exact curvature of the curved retainer plate 44.

In the instant arrangement of the keyboard according to the invention, the keys 30 are disposed so that the top faces of the keytops 27 are arranged to lie in the downwardly curved operating surface 62, without varying the dimensions and/or shapes of the keys according to the rows in which they are disposed.

The sponge member 59 used to support the movable electrode 61 on the inner surface of the top wall 57*a* of the elastic housing 57, undergoes elastic deformation upon depression of the keytop 27, which permits perfect contact of the movable electrode 61 with the stationary electrodes 60 over the entire areas of their opposite surfaces, even while the printed circuit board 52 is curved. Consequently, the capacitive key switch which includes the movable and stationary electrodes 60, 60, and the key 30, may be operated with high switching reliability.

Referring next to FIGS. 6–11, modified embodiments of the keyboard of the invention will be described. The same reference numerals will be used in these figures to identify the same components or parts as used in the first embodiment.

Figure 6:
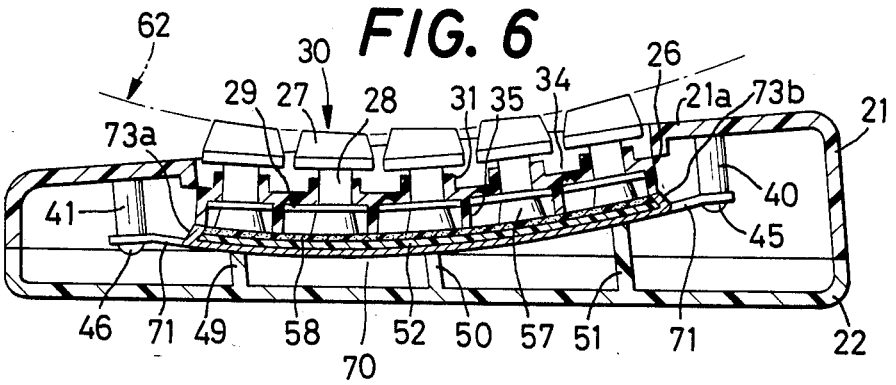
FIG. 6 is an elevational cross sectional view, corresponding to FIG. 1, of another embodiment of the keyboard.
Figure 7:
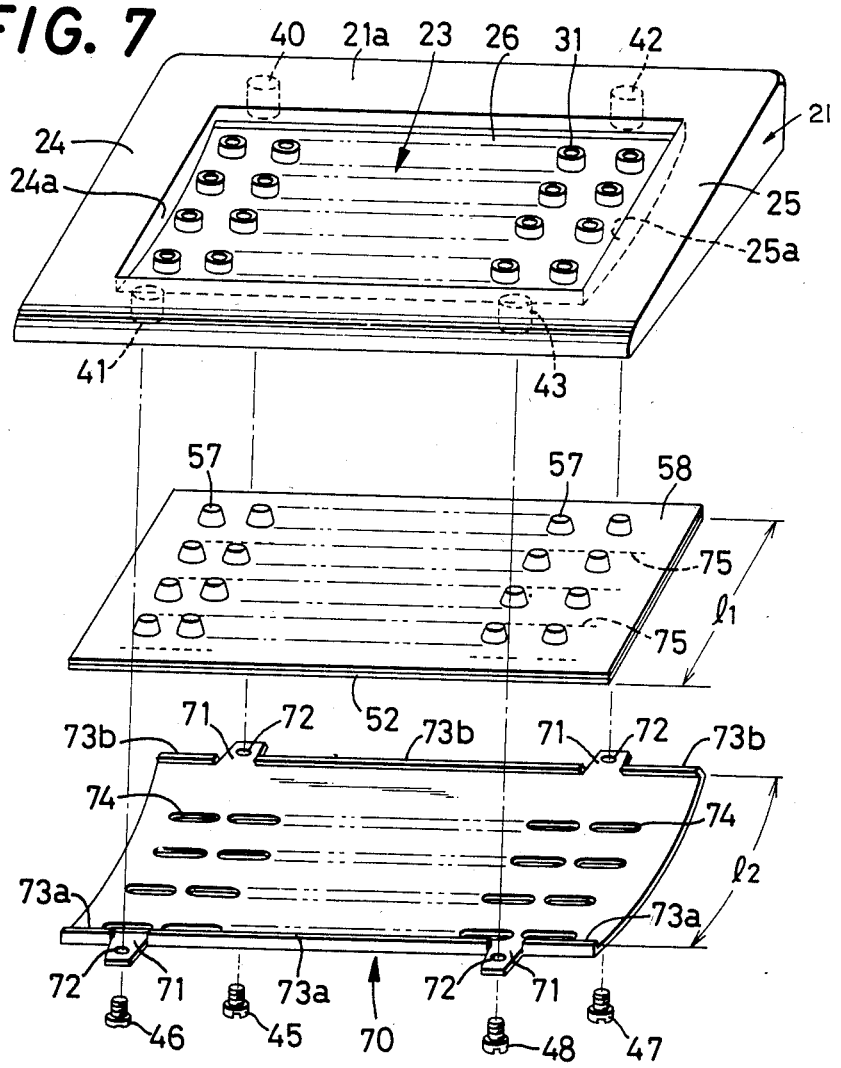
FIG. 7 is an exploded perspective view of the keyboard of FIG. 6.

FIGS. 6 and 7 show a second embodiment of the keyboard of the invention which uses a curved retainer plate 70 which is different from the curved retainer plate 44 of the first embodiment. The curved retainer plate 70 is provided with two pairs of fixing lugs 71 which have holes 72 for the screws 45–48, as used in the first embodiment (no reference numerals given to the lugs and holes in FIG. 2). The first and second pairs of fixing lugs 71 extend outwardly from the front and rear edges of the plate 70, respectively. The retainer plate 70 is further provided with a front and a rear engagement rib 73*a*, 73*b* which are formed along the front and rear edges of the plate 70, respectively. Each of these two front and rear engagement ribs 73*a*, 73*b* is disconnected by the fixing lugs 71. The engagement ribs 73*a*, 73*b* are formed by bending the front and rear edge portions of the retainer plate 70 such that the rib 73*a*, 73*b* forms an acute angle with respect to the upper surface of the plate 70 in transverse cross section thereof. That is, the ribs 73*a*, 73*b* cooperate with the adjacent front and rear edge portions of the plate 70 to define a generally V-shaped groove in cross section. The retainer plate 70 has plural rows of elongate slots 74 corresponding to the key-switches, more precisely, corresponding to the respective pairs of stationary electrodes 60. These slots 74 accommodate terminals of lead wires 75 which are connected to the key-switches and extend along the rows of the slots 74.

In assembling the keyboard, the printed circuit board 52 with the elastomeric member 58 placed thereon is first slightly curved downwardly and then set on the upper surface of the curved retainer plate 70 in such manner that the front and rear edges of the assembly 52, 58 are held in gripped engagement with the front and rear engagement ribs 73*a* and 73*b* of the retainer plate 70, respectively. It is important to note that the assembly 52, 58, and the retainer plate 70 are dimensioned so that the assembly 52, 58 is held curved following a curvature of the retainer plate 70 while the edges of the assembly 52, 58 is held in engagement with the engagement ribs 73*a*, 73*b*. Stated the other way, a width l1 of the assembly 52, 58 is determined to be substantially equal to a width l2 of the plate 70 as measured along the curvature thereof. Thus, once the assembly 52, 58 is set in its curved position along the upper surface of the curved retainer plate 70, the acutely bent engagement ribs 73*a*, 73*b* prevent the assembly 52, 58 from springing back to its flat position.

After the assembly of the printed circuit board 52 and the elastomeric member 58 has been held curved on the curved retainer plate 70 in the above manner, the assembly 52, 58, 70 is fixed to the upper casing 21 with the fixing screws 45–48 screwed to the downward bosses 40–43 on the top frame portion 21*a*. With a pressure exerted to the key-holder plate portion 26 through the curved printed circuit board 52 and elastomeric member 58, and through the partition walls 35, the key-holder plate portion 26 is forced to be curved along the curvature of the assembly 52, 58. As indicated in connection with the first embodiment, the parallel grooves 34 in the lower surface of the key-holder plate portion 26 facilitate elastic deformation of the plate portion 26 while the screws 45–48 are tightened. Thus, the keys 30 may be disposed so that the operating surface 62 defined by the top faces of the keytops 27 is downwardly curved following the curvature of the key-holder plate portion 26.

In summary, the engagement ribs 73*a*, 73*b* provided on the retainer plate 70 of this second embodiment enable the printed circuit board 52 and the member 58 to be held curved on the curved retainer plate 70 before these components are fixed to the upper casing 21. This arrangement makes it possible to eliminate the use of the screws 53–56 which are used in the first embodiment primarily to hold the assembly 52, 58 curved on the retainer plate 44. Accordingly, the upper casing 21 of the second embodiment does not have downward bosses for such screws. Thus, the engagement ribs 73*a*, 73*b* cooperate with the integrally molded top frame and key-holder plate portions 21*a*, 26, to enhance the positioning accuracy of the individual components relative to each other, and permit easier assembling of the keyboard. Further, the reduced number of components and easier assembling provide a saving of manufacturing cost of the keyboard.

Figure 8:
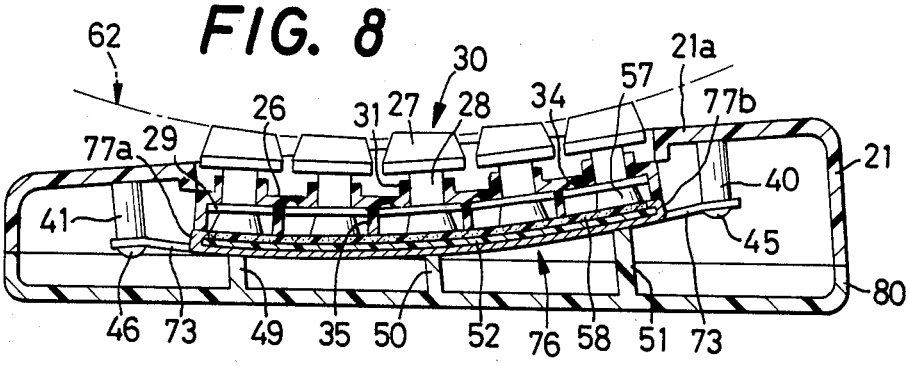
FIG. 8 is an elevational cross sectional view of a further embodiment of the keyboard using a modified form of a retainer plate alternative to that used in the embodiment of FIGS. 6 and 7.

Another embodiment of the keyboard is shown in FIG. 8, wherein a curved retainer plate 76 uses a modified form of engagement ribs 77*a*, 77*b*. While the engagement ribs 73*a*, 73*b* of the preceding embodiment are formed to an acute angle relative to the upper surface of the plate 76, the alternative engagement ribs 77*a*, 77*b* are formed such that the rib cooperates with the front or rear edge portion of the plate 76 to define a generally U-shaped channel engageable with the front and rear edges of the printed circuit board 52.

Figure 14:
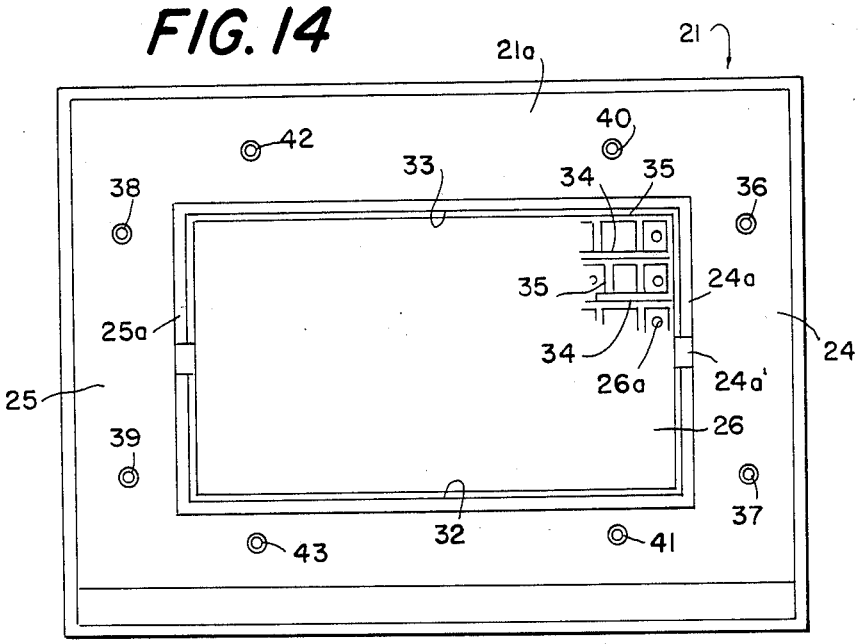
FIG. 14 is a plan view of the upper casing of FIG. 3.
Figure 15:
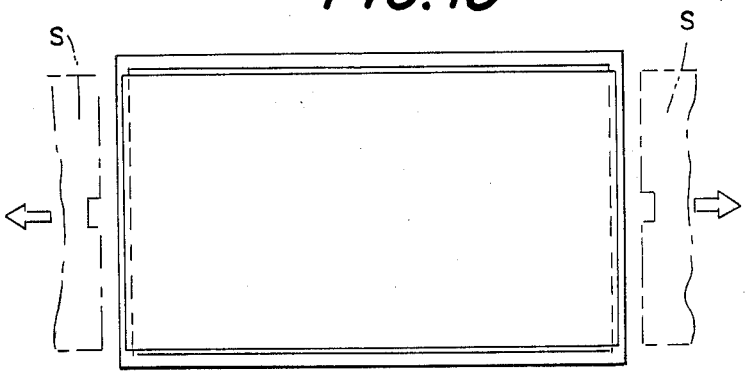
FIG. 15 is a plan view, corresponding to FIG. 14, showing another form of the upper casing.

As previously stated, the upper casing 21 is molded such that the right and left side end regions of the key-holder plate portion 26 are spaced from the right and left downward extensions 24*a*, 25*a* toward the center of the rectangular aperture 23 in the direction parallel to the front and rear sides 32, 33 of the aperture 21, as shown in FIG. 14. In this case, upper and lower molds for the upper casing 21 can be easily removed from the molding, in opposite directions away from each other. However, it is possible to mold the upper casing 21 such that the right and left side end regions of the key-holder plate portion 26 are disposed opposite to the end faces of the right and left downward extensions 24*a*, 25*a* respectively as shown in FIG. 15, so that these right and left side end regions are held in pressed contact with the convex profile of the downward extensions 24*a*, 25*a* when the curved retainer plate 44, 70, 76 is fixed to the top frame portion 21*a*. In this case, the key-holder plate portion 26 is pressed between and by the retainer plate and the downward extensions, and thereby held curved following not only the curvature of the retainer plate but also the curvature of the convex profile of the downward extensions. In this design, however, a mold should include side cores S (indicated in two-dot chain line) for separation of the right and left side end regions of the key-holder plate portion 26 from the opposite end faces of the right and left downward extensions 24*a*, 25*a*. These side cores S should be removed from the molded upper casing in lateral directions parallel to the front and rear sides 32, 33 of the aperture 21, as indicated by arrows in FIG. 15.

Figure 9:
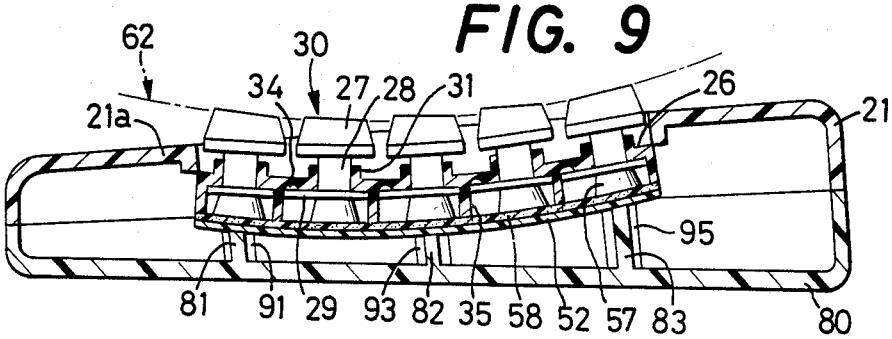
FIGS. 9 and 10 are elevational and perspective views, showing still another embodiment of the keyboard.
Figure 12:
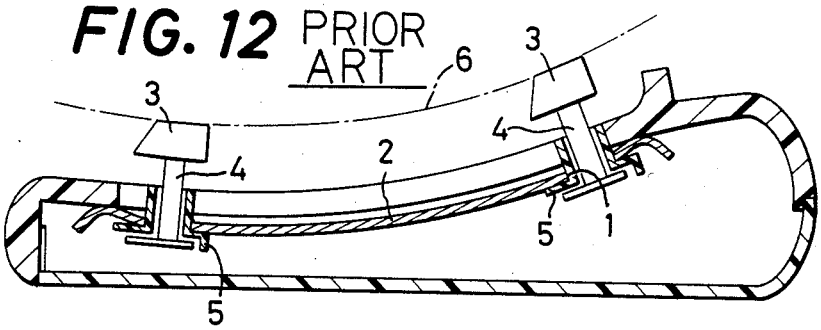
FIG. 12 PRIOR ART
FIGS. 12 and 13 are elevational views in cross section of known keyboards with keytops defining a curved operating surface.
Figure 13:
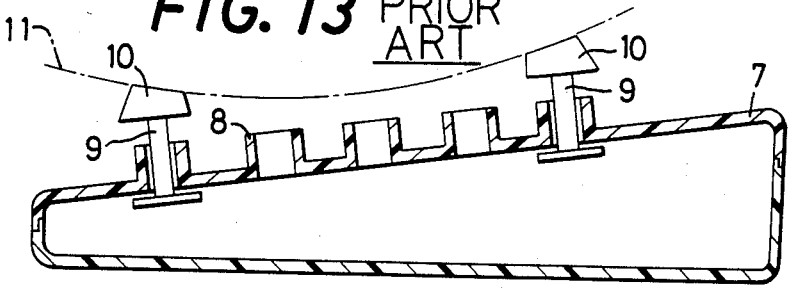
FIG. 13 PRIOR ART
Figure 10:
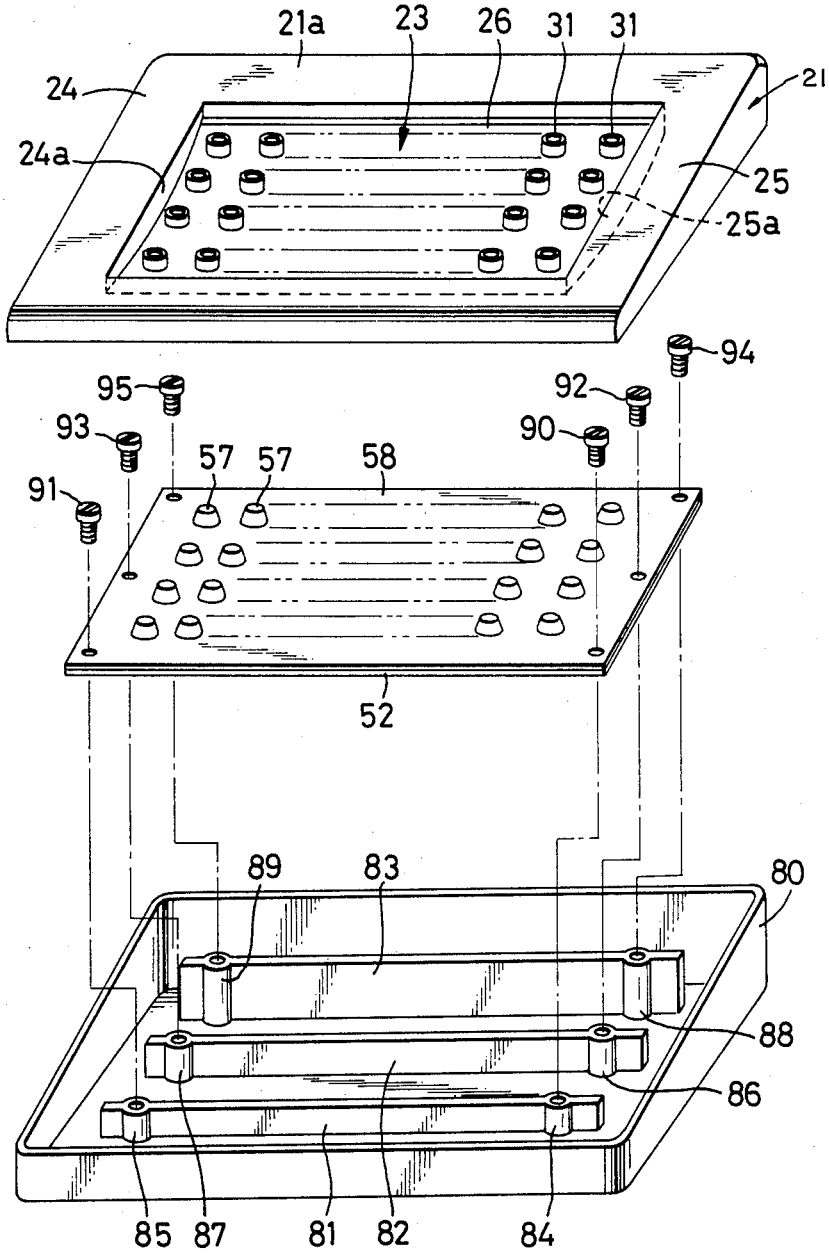
Figure 11:
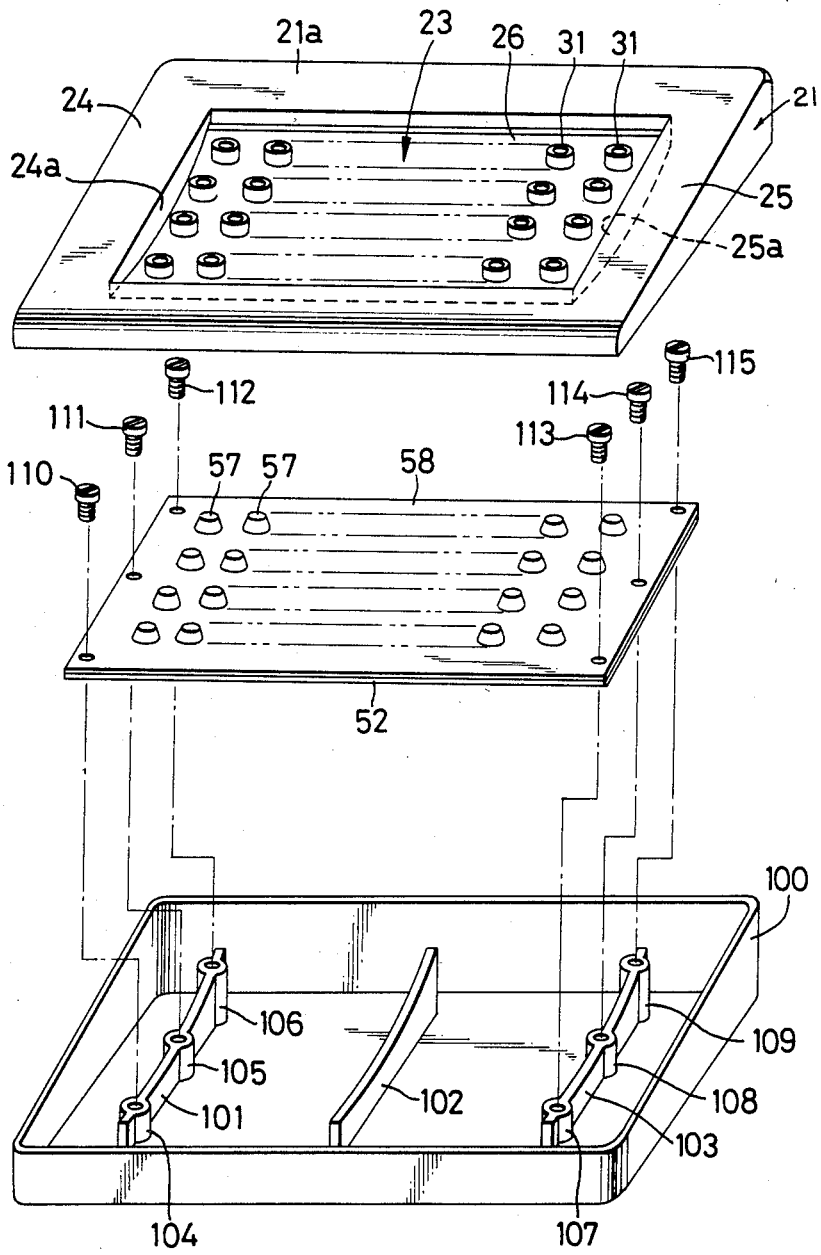
FIG. 11 is a perspective view of a further embodiment of the keyboard using a modified form of upward projections alternative to those used in the embodiment of FIGS. 9 and 10.

Referring further to FIGS. 9–11, there are illustrated further embodiments of the keyboard. In these embodiments, the upper casing 21, printed circuit board 52, and elastomeric member 58 are substantially identical to the corresponding components of the foregoing embodiments, but a rigid curved retainer plate as used in the foregoing embodiments is not used.

In the embodiment of FIGS. 9 and 10, a lower casing 80 is provided with a plurality of upward projections in the form of three support walls 81, 82 and 83. These support walls 81–83 are molded integrally with the lower casing 80 such that they extend parallel to the front and rear sides of the casing 80, i.e. parallel to the rows of the keys 30. The support walls 81–83 are spaced from each other in a direction along the right and left sides of the lower casing 80. The heights of the individual walls 81–83 are selected so that a surface generally defined by upper ends of the three walls 81–83 is downwardly curved in a plane perpendicular to the rows of the keys 30. That is, the support walls 81–83 have different heights from the bottom surface of the casing 80 so that the assembly of the circuit board 52 and the elastomeric member 58 is downwardly curved when this assembly is held in pressed abutting contact with the upper end surfaces of the walls 81–83. Thus, the three longitudinal support walls 81–83 provide a downwardly curved bearing surface for the printed circuit board 52. Each of the support walls 81–83 has a pair of fixing portions 84–85, 86–87, 88–89 near the opposite ends. These fixing portions have tapped holes for fixing screws 90–95 which are used to hold the assembly 52, 58 in abutment on the upper ends of the walls 81–83. The fixing portions 84–89 and the corresponding screws 90–95 constitute fastening means for the assembly 52, 58.

In assembling the keyboard, the assembly 52, 58 is placed on the support walls 81–83, and forced into pressed abutting contact with these upper end surfaces of the walls 81–83 by means of the fixing screws 90–95 threaded in the tapped holes in the fixing portions 84–89. With the assembly 52, 58 completely fixed to the upper ends of the walls 81–83, the assembly 52, 58 is downwardly curved following the curved bearing surface defined by the upper ends of the three support walls 81–83. Subsequently, the lower casing 80 with the assembly 52, 58 fixed to the support walls 81–83, is fixed to the upper casing 21. During this fixation, the key-holder plate portion 26 of the upper casisng 21 is pressed by the curved assembly 52, 58, and the plate portion 26 is held curved in the same manner as discussed previously. Thus, the operating surface 62 defined by the keytops 27 of the keys carried by the plate portion 26 is downwardly curved substantially following the curvature of the curved assembly 52, 58, i.e., the curvature of the bearing surface defined by the upper ends of the three support walls 81–83.

In this embodiment, a relatively heavy curved retainer plate of metal is eliminated, whereby the depth and weight of the keyboard may be reduced, while the ease of assembling is increased and the cost of manufacture is reduced.

In FIG. 11, there is shown another form of a lower casing 100 which is formed with three integral support walls 101, 102 and 103 extending perpendicularly to the rows of the keys 30. The support walls 101–103 are spaced from each other in a direction along the rows of the keys 30. Each of the outer two support walls 101 and 103 has three fixing portions 104–106, 107–109 which have tapped holes for fixing screws 110–112, 113–115, respectively. The fixing portions 104–109 and the corresponding screws 110–115 constitute fastening means for the assembly 52, 58. Each of the three support walls 101–103 has a downwardly curved upper end surface so as to provide a curved bearing surface for the printed circuit board 52. That is, the upper end surfaces of the three support walls 101–103 are downwardly curved so as to define the downwardly curved operating surface 62 of the keytops 27 when the lower casing 100 is secured to the upper casing 21.

While the invention has been described in its preferred embodiments, it is to be understood that the invention is not limited thereto; but may be otherwise embodied within the scope of the following claims.

What is claimed is:

1. A keyboard having multiple key-switches providing electrical outputs upon activation thereof, each of the key-switches including a key having a finger-pressed top face, comprising:

an upper casing which is a one-piece molding made of synthetic resin, including (a) a top frame portion which has a substantially rectangular aperture formed through a thickness thereof and which further has a pair of side walls defining opposite right and left sides of said rectangular aperture, said top frame portion further having a pair of downward extensions which extend downwardly from the respective side walls, and further including (b) a key-holder plate portion of generally planar flat shape which is integral with said top frame portion, said key-holder plate portion supporting the multiple keys in plural rows perpendicular to said right and left sides o the rectangular aperture, said key-holder plate portion having right and left side end regions adjacent to said downward extensions, transversely central areas of said side end regions being materially connected, during molding of said upper casing, to said downward extensions, said key-holder plate portion being spaced from said downward extensions and said top frame portion, except at said transversely central areas of said side end regions; and holding means for holding said key-holder plate portion curved in cross section across said plural rows of the keys, said holding means having means defining a curvature, and means for holding said key holder plate portion elastically deformed following said curvature, so that a surface generally defined by the top faces of said multiple keys is downwardly convexed in said cross-section.

2. A keyboard as set forth in claim 1, wherein said key-holder plate portion has holes through which said keys extend in a direction perpendicular to a plane of the key-holder plate portion, and further has integral guide portions extending in said perpendicular direction to guide the keys in said aperture across the thickness of said aperture.

3. A keyboard as set forth in claim 2, wherein each of said multiple keys includes a keystem extending through corresponding one of said holes and the corresponding guide portion, and a keytop fixed to an upper end of said keystem and having said top face.

4. A keyboard as set forth in claim 1, wherein each of said downward extensions has a convex profile at its lower end, said holding means including retaining means for holding said side end regions of the key-holder plate portion in pressed contact with said convex profile of said downward extensions, whereby said key-holder plate portion is held curved to said convex profile through elastic deformation thereof.

5. A keyboard as set forth in claim 1, wherein said holding means comprises a curved retainer plate, and fastening means for fixing said curved retainer plate to said top frame portion of the upper casing, and thereby holding said key-holder plate portion in a curved position.

6. A keyboard as set forth in claim 1, further comprising a printed circuit board disposed below said key-holder plate portion and cooperating with said keys to provide said electrical outputs, said holding means comprising a curved retainer plate which is disposed below said printed circuit board to support the circuit board, said retainer plate having engagement ribs along front and rear edges thereof parallel to said plural rows of the keys, said engagement ribs engaging corresponding front and rear edges of said printed circuit board to hold the printed circuit board curved to a curvature of the retainer plate, said holding means further comprising fastening means for fixing said curved retainer plate and the curved printed circuit board to said top frame portion of the upper casing, and thereby holding said key-holder plate portion in a curved position.

7. A keyboard as set forth in claim 6, wherein said engagement ribs are formed by bending said front and rear edge portions of the curved retainer plate such that each of said ribs forms an acute angle with respect to a surface of said retainer plate on which said printed circuit board rests.

8. A keyboard as set forth in claim 6, wherein said engagement ribs are formed by bending said front and rear edge portions of the curved retainer plate such that each of said ribs cooperates with corresponding one of said edge portions to define a generally U-shaped channel engaging said front and rear edges of said printed circuit board.

9. A keyboard as set forth in claim 6, wherein said curved retainer plate has plural slots, corresponding to said key-switches, to accommodate lead wire terminals connected to said printed circuit board.

10. A keyboard as set forth in claim 1, further comprising a printed circuit board disposed below said key-holder plate portion and cooperating with said keys to provide said electrical outputs, and further comprising a lower casing cooperating with said upper casing to constitute a keyboard housing, said holding means comprising a plurality of upward projections fixed to and extending from a bottom of said lower casing, said upward projections having upper ends which cooperates to define a curved bearing surface curved in a plane perpendicular to said plural rows of the keys, said holding means further comprising fastening means for fixing said printed circuit board to said upper ends of said upward extensions.

11. A keyboard as set forth in claim 10, wherein said upward projections comprise a plurality of support walls supported on said bottom of said lower casing and extending parallel to said plural rows of the keys, said support walls being spaced from each other along said right and left sides of said rectangular aperture, said support walls having tapped holes in upper ends thereof and different heights from a flat surface of said bottom of the lower casing so as to define said curved bearing surface, said fastening means comprising screws which are threaded into said tapped holes to fix said printed circuit board to said upper ends of said support walls.

12. A keyboard as set forth in claim 10, wherein said upward projections comprise a plurality of support walls supported on said bottom of said lower casing and extending parallel to said right and left sides of said rectangular aperture, said support walls being spaced from each other along said plural rows of the keys, at least two of said support walls having tapped holes in upper ends thereof, and each of said support walls having a curved upper end surface so as to provide said curved bearing surface, said fastening means comprising screws which are threaded in said tapped holes to fix said printed circuit board to said curved upper end surface of the support walls.

13. A keyboard as set forth in claim 1, wherein said key-holder plate portion has a plurality of grooves formed parallel to said plural rows of the keys over an entire length thereof, to facilitate elastic deformation thereof when held by said holding means.

14. A keyboard as set forth in claim 13, wherein a depth of said grooves is increased as a distance of the groove from a transverse center of said key-holder plate portion is increased.

15. A keyboard as set forth in claim 1, wherein said key-holder plate portion includes a plurality of integral partition walls defining a plurality of compartments which correspond to said multiple keys.

16. A keyboard as set forth in claim 15, wherein said key-holder plate portion has holes through which said keys extend in a direction perpendicular to a plane of the key-holder plate portion, and further has integral guide portions extending from one surface thereof toward said top frame portion, said partition walls extending from the other surface of said key-holder plate portion and cooperating with said guide portions to guide said keys.

17. An upper casing of a keyboard having multiple switches which include keys disposed in plural rows and having finger-pressed top faces, a surface generally defined by the top faces of the keys being downwardly curved in a plane perpendicular to the rows of the keys, said upper casing comprising:

a top frame portion which has a substantially rectangular aperture formed through a thickness thereof and which further has a pair of side walls defining opposite right and left sides of said rectangular aperture, said top frame portion further having a pair of downward extensions which extend downwardly from the respective side walls; and a key-holder plate portion of generally planar flat shape which is integral with said top frame portion, said key-holder plate portion supporting the multiple keys in plural rows perpendicular to said right and left sides of the rectangular aperture, said key-holder plate portion having right and left side end regions adjacent to said downward extensions, transversely central areas of side end regions being materially connected, during molding of said upper casing, to said downward extensions, said key-holder plate portion being spaced from said downward extensions and said top frame portion, except at said transversely central areas of said side end regions, before said upper casing is assembled into the keyboard, said key-holder plate portion being downwardly curved with elastic deformation thereof, when said upper casing is assembled into the keyboard, so that said surface generally defined by the top faces of the keys is downwardly curved.

18. In a keyboard having multiple key-switches each comprising a key, a movable electrode movable with the key, and at least two stationary electrodes, the multiple keys of said multiple key-switches having the same dimensions and being carried by an upper casing in plural rows and movably such that a surface generally defined by top faces of the keys is downwardly curved in a plane perpendicular to the rows of the keys, the improvement comprising:

a printed circuit board carrying the stationary electrodes and disposed below the rows of said keys, said movable electrodes and said stationary electrodes cooperating to provide electrical outputs upon movements of said keys; and a curved retainer plate which is disposed below said printed circuit board to support the circuit board, said retainer plate having engagement ribs along front and rear edges thereof parallel to said rows of the keys, said engagement ribs engaging corresponding front and rear edges of said printed circuit board to hold the printed circuit board curved to a curvature of the retainer plate, whereby said surface generally defined by top faces of the keys is downwardly curved substantially following said curvature of the retainer plate.

19. In a keyboard having multiple key-switches each comprising a key, a movable electrode movable with the key, and at least two stationary electrodes, the multiple keys of said multiple key-switches having the same dimensions and being carried by an upper casing in plural rows and movably such that a surface generally defined by top faces of the keys is downwardly curved in a plane perpendicular to the rows of the keys, the improvement comprising:

a printed circuit board of generally flat shape carrying the stationary electrodes and disposed to support the rows of said keys, said movable electrodes and said stationary electrodes cooperating to provide electrical outputs upon movements of said keys;

a lower casing cooperating with said upper casing to constitute a keyboard housing;

support means comprising a plurality of upward projections fixed to and extending from a bottom of said lower casing, said upward projections having upper ends which cooperate to define a curved bearing surface curved in a plane perpendicular to said plural rows of the keys; and fastening means for fixing said printed circuit board to said upper ends of said upward projections, and thereby holding the printed circuit board to a curvature of said curved bearing surface, whereby said surface generally defined by top faces of the keys is downwardly curved substantially following said curvature of the curved bearing surface.

20. A keyboard as set forth in claim 19, wherein said upward projections extend parallel to said rows of the keys and are spaced from each other perpendicularly to said rows of the keys, said upward projections having different heights from said bottom of the lower casing so as to define said curved bearing surface.

21. A keyboard as set forth in claim 19, wherein said upward projections extend perpendicularly to said rows of the keys and are spaced from each other along said rows of the keys, each of said upward projections having a curved upper end surface so as to provide said curved bearing surface.

22. A keyboard as set forth in claim 1, wherein said right and left side end regions of the key-holder plate portion are spaced from the respective downward extensions of the top frame portion toward a center of said rectangular aperture, in a direction parallel to said plural rows of the keys.

* * * * *